US010124380B2

(12) United States Patent
Bender

(10) Patent No.: US 10,124,380 B2
(45) Date of Patent: Nov. 13, 2018

(54) DEVICE FOR ADJUSTING A ROLL IN A ROLL STAND

(71) Applicant: SMS Group GmbH, Dusseldorf (DE)

(72) Inventor: Hans-Juergen Bender, Olpe (DE)

(73) Assignee: SMS Group GmbH, Duesseldorf (DE)

( * ) Notice: Subject to any disclaimer, the term of this patent is extended or adjusted under 35 U.S.C. 154(b) by 193 days.

(21) Appl. No.: 15/039,491

(22) PCT Filed: Nov. 24, 2014

(86) PCT No.: PCT/EP2014/075431

§ 371 (c)(1),
(2) Date: May 26, 2016

(87) PCT Pub. No.: WO2015/078822

PCT Pub. Date: Jun. 4, 2015

(65) Prior Publication Data

US 2016/0375475 A1 Dec. 29, 2016

(30) Foreign Application Priority Data

Nov. 29, 2013 (DE) ..... 10 2013 224 644

(51) Int. Cl.
*B21B 31/24* (2006.01)
*B21B 45/02* (2006.01)

(52) U.S. Cl.
CPC ..... *B21B 31/24* (2013.01); *B21B 45/0239* (2013.01)

(58) Field of Classification Search
CPC ..... B21B 31/20; B21B 31/22; B21B 31/24
See application file for complete search history.

(56) References Cited

U.S. PATENT DOCUMENTS

| | | | |
|---|---|---|---|
| 1,190,759 | A | 7/1916 | Harrington |
| 3,104,567 | A | 9/1963 | Sieger |
| 7,047,783 | B2 | 5/2006 | Klein |

FOREIGN PATENT DOCUMENTS

| | | |
|---|---|---|
| CN | 201692991 | 1/2011 |
| CN | 201855834 | 6/2011 |
| CN | 201969730 | 9/2011 |
| GB | 1221979 | 2/1971 |
| JP | 6320107 | 1/1988 |
| JP | 07218300 | 8/1995 |
| JP | 08108204 | 4/1996 |
| SU | 269129 | 4/1970 |
| SU | 386691 | 6/1973 |

*Primary Examiner* — Debra Sullivan
(74) *Attorney, Agent, or Firm* — Abelman, Frayne & Schwab

(57) ABSTRACT

The invention relates to a device for adjusting a roll in a roll housing 210 of a roll stand. The device comprises a motor for providing an adjusting force for the roll; a drive shaft 120 that can be actuated in a rotatory manner by the motor; and a pressure spindle for transmitting the adjusting force of the motor to the roll. In order to do away with the upstream worm gear used in the prior art, according to the invention, the motor is designed in the form of a hydro- or torque-motor, the pressure spindle 130 is provided with an axially oriented cylindrical receiving space on the motor-side end face 132, the drive shaft 120 can project into the receiving area of the pressure spindle, and the pressure spindle 130 and the drive shaft 120 are coupled to one another in a rotatory manner inside the receiving area.

10 Claims, 2 Drawing Sheets

DEVICE FOR ADJUSTING A ROLL IN A ROLL STAND

RELATED APPLICATIONS

This application is a National Phase application of International Application PCT/EP2014/075431 filed Nov. 24, 2014 and claiming priority of German Application DE 10 2013 224644.7 filed Nov. 29, 2013, both applications are incorporated herein by reference thereto.

BACKGROUND OF THE INVENTION

Field of the Invention

The invention relates to a device for adjusting a roll in a roll housing of a roll stand. In addition, the invention relates to roll stand for rolling, in particular, metal rolled goods.

Description of the Prior Art

Devices of the above-mentioned art for adjusting a roll and, thereby, for adjusting a roll gap in a roll stand are known in the state-of-the art since long ago, see, for example, CH 201855834(U), CN 201692991 (U), JP 07218300A, JP 08108204A, CN 201969730 (U), DE 1293108, U.S. Pat. No. 1,190,759, GB 1221979 or DE 412920.

A device for adjusting a roll in a roll stand is described in Japanese patent application JP 63020107A. This publication discloses a roll stand having a roll housing and the mentioned device for adjusting the roll, here, for adjusting the upper back-up roll. The device includes a motor formed as a hydraulic motor that rotates a pressure spindle via a worm gear. The pressure spindle is rotatably supported on an upper side of the roll housing of the roll stand with the rotational axis extending transversely. During rotation, the pressure spindle is displaced vertically and thereby acts on the chock of the upper back-up roll. In this way, the adjusting force that acts on the back-up or work rolls and/or that influences their position and, thereby, the size of the roll gap, can be adjusted with the motor as desired. The mentioned worm gear engages the pressure spindle; this is very expensive, space-consuming, and requires separate lubrication.

Proceeding from this state-of-the art, the object of the invention is to so improve the known device for adjusting a roll in a roll housing of a roll stand and the corresponding roll stand that the worm gear and its lubrication can be eliminated.

SUMMARY OF THE INVENTION

The object of the invention is achieved by a device for adjusting the roll. This is characterized in that the pressure spindle has, at its motor-side end surface an axially extending cylindrical receiving space, the drive shaft projects into the receiving space of the pressure spindle, and the pressure spindle and the drive shaft are connected in an interior of the receiving space, for joint rotation with each other.

The language "motor-side end surface" designates that end surface of the pressure spindle which is adjacent to the motor. Opposite the motor-side end surface, is the end surface adjacent to the roll chock.

The claimed use of a hydromotor or a torque motor provides, in comparison with, e.g., conventional electric motor, not a torque motor, an advantage that consists in a possibility to apply bigger torques without use of additional gear. Moreover, advantageously, the available, in the roll stand, hydraulic system for adjusting the roll gap, can be use for operating the hydraulic motor.

By providing a high-torque motor, together with a rotary connection between the pressure spindle and the drive shaft in the interior of the cylindrical receiving space of the pressure spindle, advantageously, the above-mentioned costly worm gear, which is known form the state-of-the art, can be eliminated. In addition to the costs of manufacturing, purchase, and maintenance of the worm gear, the space for the above-mentioned worm gear is also eliminated.

According to a first embodiment of the invention, a form-locking connection between the pressure spindle and the drive shaft is provided in the interior of the receiving space.

According to the first alternative, the form-locking connection between the pressure spindle and the drive shaft is so formed that the receiving space of the pressure spindle is formed as a spline hub with a spline hub profile, and the drive shaft is formed as a spline shaft for form-lockingly engaging in the spline hub profile.

According to the second alternative, the form-locking connection is so formed that the receiving space is formed as a polygonal hub with a polygonal profile, and the drive shaft is formed as a polygonal shaft with same number of sides for form-lockingly engaging the polygonal shaft in the polygonal hub of the pressure spindle.

The spline hub or the polygonal hub is so formed advantageously that a spline hub sleeve or a polygonal sleeve is inserted at the motor-side end surface of the pressure spindle and which is connected with the pressure spindle for joint rotation therewith and, advantageously, without a possibility of displacement in the axial direction relative thereto, and forms the receiving space with the spline hub profile or polygonal profile. The advantage of using a spline hub sleeve consists in that it is simply and economically produced, while forming a spline hub profile directly on the inner side of the receiving space of the pressure spindle. In addition, the advantage of the spline hub sleeve consists in that it, upon the wear of the spline hub profile, can be easily replaced as a worn part. The polygonal sleeve has the same advantages.

Between the motor and the drive shaft, advantageously, a coupling is provided in order to be able to disconnect the motor from the motor shaft, e.g., for maintenance purposes.

The object of the invention with regard to the roll stand is achieved by providing a roll stand that includes the inventive device. The advantages of this roll stand correspond to the mentioned above advantages of the claimed device for adjusting a roll.

According to a first embodiment the roll stand includes and axial bearing for rotatably supporting the drive shaft, and the axial bearing is supported by a mounted on an upper side of the roll housing, first support device at a fixed predetermined axial distance to the upper side of the roll housing. This constructive measure insures that the rotatably supported drive shaft is held in a fixed predetermined vertical relative position, in particular, at a fixed predetermined vertical distance to the roll housing. The formation of the axial bearing as a spherical roller bearing provides, advantageously, the drive shaft with a degree of freedom in a radial direction, e.g., enables a see-saw motion. By insuring this degree of freedom, a mechanical overload of the drive shaft is prevented even at a non-circular rotation of the drive spindle.

The axial bearing is arranged in a lubricant chamber that is supplied with a lubricant via a lubricant feed. On the bottom of the lubricant chamber, there is provided an overflow for the lubricant which insures that the height of the lubricant in the interior of the lubricant chamber does not exceed a predetermined height determined by the height of the overflow.

The excessive lubricant that flows-off through the overflow is discharged, according to the invention, through a shell-shaped roof provided on the motor-side end surface of the pressure cylinder and therefrom through a first annular gap between the drive shaft and a rim of a circular opening through which the drive shaft extends and flows into the cylindrical receiving space of the pressure spindle. From the receiving space, the lubricant flows further through a lubricant drain into a second annular gap between the pressure cylinder and the inner surface of a bore in the roll housing for lubricating the pressure spindle.

BRIEF DESCRIPTION OF THE DRAWINGS

The description is supplemented by two drawing figures, wherein.

DETAILED DESCRIPTION OF THE PREFERRED EMBODIMENT

Figure 1:
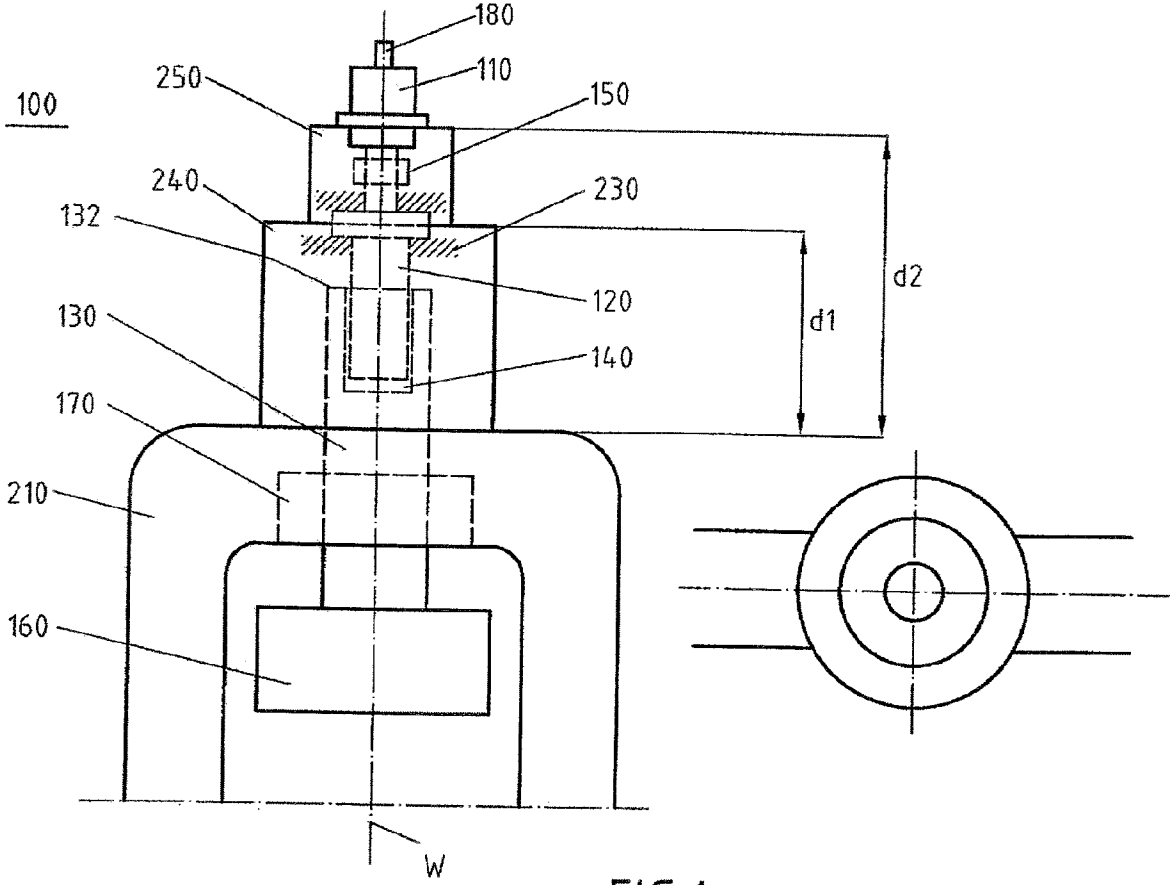
FIG. 1 shows a schematic view of the inventive device.

FIG. 1 shows an inventive device 100 for adjusting a roll in a roll housing 210 of a roll stand. The device includes a motor 110, preferably a torque motor or the hydraulic motor, shorty, hydromotor for providing an adjust position for the roll. The motor 110 is located above the roll housing 210 and is supported by a second support unit 250 opposite an outer side of the roll housing 210, wherein the second support unit 250 itself is supported against a first support unit 240. The two support units fixedly position the motor 110 at a fixed distance d2 to the outer side of the roll housing 210. The hydraulic motor is axially aligned with a drive shaft 120 which is rotated thereby. Advantageously, a coupling 150 is provided between the drive shaft 120 and the motor and is arranged in the second support unit 250. The drive shaft 120 is secured, e.g., in the transition region between the first and second support units 240, 250, in an axial bearing 230 at a predetermined height d1 above the outer side of the roll housing 210. By positioning the drive shaft 120 in the axial bearing, the drive shaft 150 is held in a predetermined relative position or height to the roll housing 210.

The drive shaft 120 serves for transmission of a torque generated by the motor 110 to a pressure spindle 130 which, in turn, transmits the adjusting force to the roll. The shaft of the motor 110 on one side of the coupling, the drive shaft 120 on the other side of the coupling, and the pressure spindle 130 are axially aligned, i.e., their central line extends in an axial, here, perpendicular direction W.

The hydro-or torque motor is, preferably formed for applying a load torque of above 4 kNm during rough rolling in a conventional hot strip train, or above 30 kNm during rolling of heavy metal sheets. These values are held under assumption of very favorable, small friction ratios; for security reasons, for practical use, these values are enhanced with a safety coefficient.

On the motor end side 132 of the pressure spindle 130, an axially extending cylindrical receiving space 140 is formed for receiving the drive shaft 120 in the assembled condition of the device. For transmitting the motor-generated torque to the pressure spindle 130, the drive shaft 120 and the pressure spindle 130 are connected, preferably formlockingly, in the interior of the receiving space 140 for joint rotation with each other. E.g., the pressure spindle 130 is formed, on the inner side of its receiving space 140, as a spline hub, i.e., it is provided with a spline hub profile on its circumference, and simultaneously, the drive shaft is formed as a spline shaft for engaging the spline hub profile of the pressure spindle 130. Alternatively, the formlocking connection can be obtained by forming the receiving space of the pressure spindle as a polygonal hub and the drive shaft as a polygonal shaft, wherein the polygonal shaft is engaged in the polygonal hub.

As its end remote from the motor, the pressure spindle has a so-called pressure head 160 that acts on a roll chock in the roll stand. With a two-high stand which has two drive shafts, the pressure head 160 of the pressure spindle 130 acts on the sleeve bearings, which are also called chocks, of the drive shafts, and when used in four-high stand having two work and two back-up rolls, acts on chocks of the back-up rolls. The pressure head 160 serves for decoupling of the rotational movement of the spindle from its simultaneous vertical movement, so that a pure vertical movement is applied to a respective chock of the adjustable roll, without a rotational component. The vertical movement of the pressure spindle 130 is carried out using a retainer nut 170 which is mounted in the roll housing 210 without possibility of rotation. The pressure spindle 130 is screwed into the retainer nut. When the drive or spline shaft 120 rotates the pressure spindle 130, the retainer nut simultaneously provides for the vertical movement of the pressure spindle, whereby the adjustment position of the roll chock which is located beneath the pressure spindle 160 can be adjusted.

Figure 2:
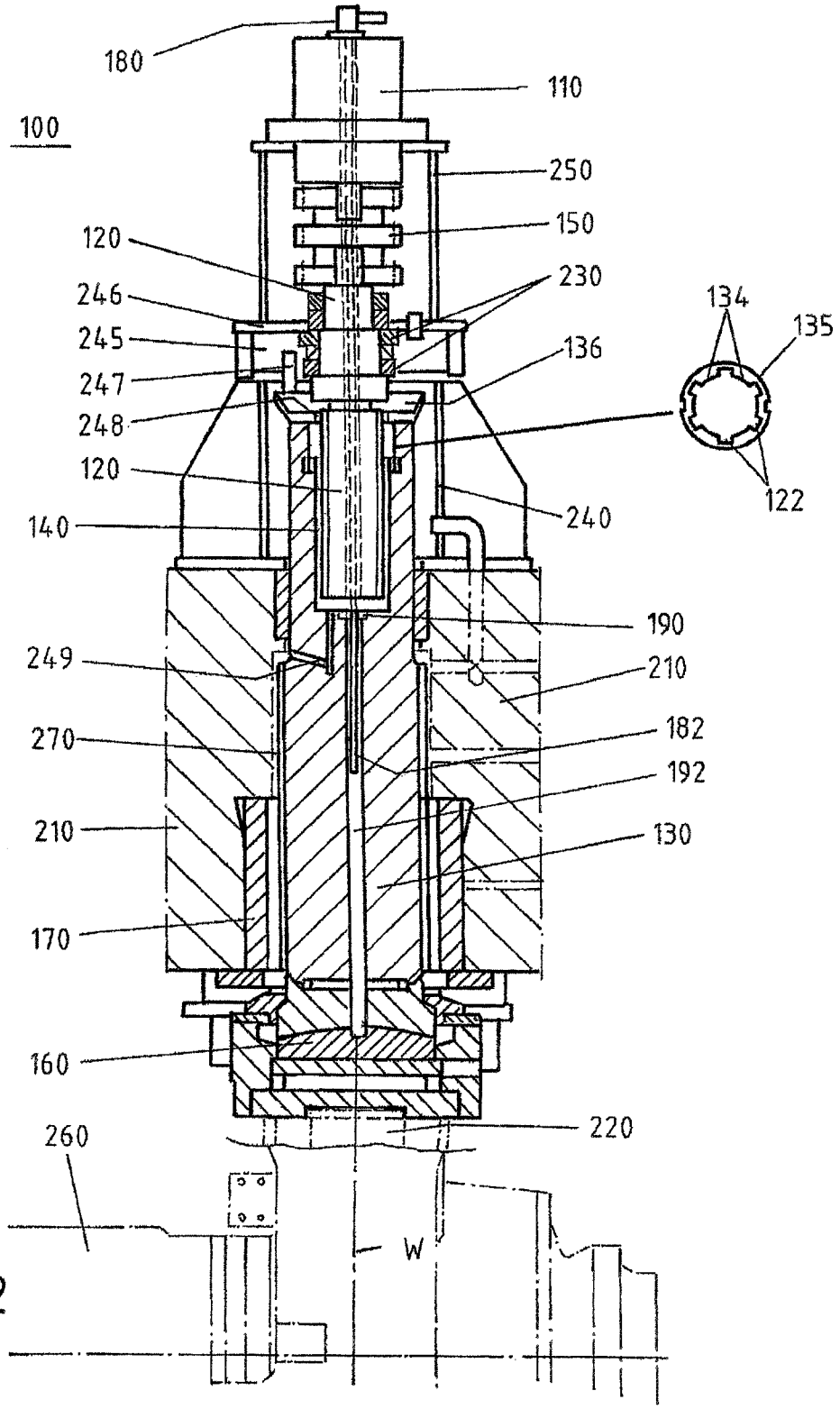
FIG. 2 shows a detailed view of the device shown in FIG. 1.

FIG. 2 shows in detail the elements shown in FIG. 1. E.g., the spline profile 134 on the inner side of the cylindrical receiving space 140 is clearly visible, with the spline profile being formed in a spline hub sleeve 135 the longitudinal and transverse cross-sections of which are shown in FIG. 2. The spline hub sleeve can, e.g., be secured in the receiving space 140, without the possibility of rotation, with a key, not shown in FIG. 2. Complementary to the spline hub profile, the spline shaft 120, which engages in the spline hub for transmitting the torque, is uncoupled.

FIG. 2 further shows that between the first support unit 240 and the second support unit 250 which are called lantern supports, a lubricant chamber 245 is provided which is supplied by a lubricant feed 246. The lubricant is used for lubrication of the axial bearing 230. On the bottom side of the lubricant chamber 245, an overflow 247 is formed which insures that the lubricant does not overrun a predetermined height defined by the height of the overflow. The excess lubricant flows off the lubricant chamber 245, through the overflow 247 into a located beneath a shell-shaped roof 136 provided on the motor-side end surface of the pressure spindle 130. The roof 136 has a circular opening for passing of the spline shaft therethrough. Between the spline shaft 120 and the rim of the circular opening, an annular gap 240 is formed through which the lubricant flows downward into the receiving space 140 for lubricating located there polygonal or spline gear consisting of the hub and the shaft. From the receiving chamber 140, the lubricant flows further through a lubricant overflow conduit 249 into a fixing screw in a second annular gap 270 between the pressure spindle 130 and a bore is the roll housing 210 in which the pressure spindle is located.

As shown in FIGS. 1 and 2, the same components of the inventive device, i.e., the motor 110, the coupling 150, the drive or spline shaft 120, and the pressure spindle 130 are axially aligned. The motor directly drive the drive shaft via the coupling.

Above the motor 110, a position sensor 180 can be stationary arranged for sensing a respective actual position of the roll 260. The position sensor has a sensor rod 182 that, preferably extends into an axial bore 192. The bore extends through the motor 110, the coupling 150, the drive or spline shaft 120, and the pressure spindle 130 up to the pressure head 160. The sensor rod 182 projects into the pressure spindle and extends there through a ring-shaped magnet 190 which is fixedly connected with the pressure spindle. During the vertical movement of the pressure spindle, the magnet is vertically displaced relative to the stationary sensor rod 192. The position sensor 180 determines the respective spindle 130 based on this relative movement.

LIST OF REFERENCE NUMERALS

100 Device
110 Motor
120 Drive Shaft
122 Teeth of the spline shaft
130 Pressure spindle
132 Motor-side end surface of the pressure spindle
134 Spline hub profile
135 Spline hub sleeve
136 Roof
140 Receiving space
150 Coupling
160 Pressure head
170 Pressure nut
180 Position sensor
182 Sensor rod
190 Annular magnet
192 Bore
210 Roll housing
220 Chock
230 Axial bearing
240 First support device
245 Lubricant chamber
246 Lubricant feed
247 Overflow
248 First annular gap
249 Lubricant flow-off
250 Second support device
260 Roll
270 Second annular gap between the pressure spindle and the roll housing
d1 Distance of the axial bearing from the roll housing
d2 Distance of the motor from the outer side of the roll housing
W Vertical axial direction

The invention claimed is:

1. Device (100) for adjusting a roll (260) in a roll housing (210) of a roll stand, comprising:
- a motor (110) in the form of a hydro- or torque motor for adjusting a vertical position of the roll;
- a drive shaft (120) rotatable by the motor;
- a vertically displaceable pressure spindle (130) for transmitting an adjusting force to the roll,
- wherein the pressure spindle has, at a motor-side end surface (132) thereof, an axially extending cylindrical receiving space (140),
- the drive shaft (120) projects into the receiving space of the pressure spindle, and
- the pressure spindle (130) and the drive shaft (120) are connected, in an interior of the receiving space (140) for joint rotation with each other by a form-locking connection, characterized in that
- the form-locking connection is so formed that the pressure spindle (130) has, on an inner side of the receiving space a spline hub profile (134) distributed over a circumference thereof, and the drive shaft (120) is formed as a spline shaft for engaging in the spline hub profile.

2. Device according to claim 1,
characterized in that
- a spline hub sleeve (135) is inserted at the motor-side end surface of the pressure spindle in a axial direction, is fixedly connected with the pressure spindle (130), and forms the spline hub profile (134) of the inner side of the receiving space.

3. Device according to claim 1,
characterized in that
- a coupling (150) is provided for a releasable rotary connection of the drive shaft (120) with the motor (110).

4. Device according to claim 1,
characterized in that
- the motor (110), the drive shaft (120) and the pressure spindle (130) are axially aligned one after another.

5. Roll stand, comprising a roll housing (210) on a drive side and a roll housing on an operating side thereof between which rolls for rolling a rolled stock are rotatable supported in respective chocks (220), wherein at least one of the roll housings is characterized by
- including the device (100 for adjusting a roll (260) in the roll housing (210) having: a motor (110) in form of a hydro- or torque motor for adjusting a vertical position of the roll;
- a drive shaft (120) rotatable by the motor;
- a vertically displaceable pressure spindle (130) for transmitting an adjusting force to the roll
- wherein the pressure spindle has, at a motor-side end surface (132) thereof, an axially extending cylindrical receiving space (140),
- the drive shaft (120) projects into the receiving space of the pressure spindle, and
- the pressure spindle (130) and the drive shaft (120) are connected, in an interior of the receiving space (140) for joint rotation with each other by a form-locking connection, characterized in that
- the form-locking connection is so formed that the pressure spindle (130) has, on an inner side of the receiving space a spline hub profile (134) distributed over a circumference thereof, and the drive shaft (120) is formed as a spline shaft for engaging in the spline hub profile.

6. Roll stand according to claim 5,
characterized by
- an axial bearing (230) for rotatably supporting the drive shaft (120); and by a first support device mounted on an upper side of the roll housing for retaining the axial bearing at a first fixed predetermined axial distance (d1) to the upper side of the roll housing and for retaining the rotatably supported drive shaft (120) in a fixed position relative to the roll housing (210).

7. Roll stand according to claim 6,
characterized in that
- the axial bearing is formed as a spherical roller bearing.

8. Roll stand according to claim 6, wherein the roll housing is characterized by a second support device (250) supported on the first support device (240) for retaining the motor (110) at a fixed predetermined vertical distance (d2) to the upper side of the roll housing.

9. Roll stand according to claim 8, characterized in that between the first and second support devices (240, 250) at a height of the axial bearing (230), there is provided a lubricant chamber (245) with a lubricant feed (246) and with at least one circular opening for passing the drive shaft therethrough, for lubricating the axial bearing, wherein an overflow (247) for lubricant is formed on a bottom side of the lubricant chamber.

10. Roll stand according to claim 9, characterized in that on the motor-side end surface of the pressure spindle, a shell-shaped roof (136) is provided for collecting lubricant that flows off through the overflow (247) downwardly, wherein the roof further has a further circular opening for passing the drive shaft (120) therethrough, wherein an annular gap (248) is formed between the drive shaft and a rim of the further circular opening, and in that within the cylindrical receiving space in the pressure spindle (130), a lubricant flow-off (249) is provided for discharging the lubricant penetrated through the first annular gap and flowing in the interior of the receiving space along the drive shaft downwardly, through a second annular gap (270) between the pressure spindle (130) a bore in the roll housing (210).

* * * * *